US010379470B2

(12) United States Patent
Kobayashi

(10) Patent No.: US 10,379,470 B2
(45) Date of Patent: Aug. 13, 2019

(54) FUSER INCLUDING ROTATION BODY AND ENDLESS BELT

(71) Applicant: Brother Kogyo Kabushiki Kaisha, Nagoya-shi, Aichi-ken (JP)

(72) Inventor: Akihiro Kobayashi, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/138,220

(22) Filed: Sep. 21, 2018

(65) Prior Publication Data

US 2019/0094770 A1 Mar. 28, 2019

(30) Foreign Application Priority Data

Sep. 27, 2017 (JP) ..... 2017-186931

(51) Int. Cl.
*G03G 15/20* (2006.01)

(52) U.S. Cl.
CPC ..... *G03G 15/2053* (2013.01); *G03G 15/206* (2013.01); *G03G 15/2064* (2013.01); *G03G 2215/2009* (2013.01)

(58) Field of Classification Search
CPC ..... G03G 15/2053; G03G 15/206; G03G 15/2064; G03G 2215/2009; G03G 2215/2041
USPC ..... 399/329
See application file for complete search history.

(56) References Cited

U.S. PATENT DOCUMENTS

2016/0252860 A1* 9/2016 Kadowaki ..... G03G 15/2053 399/331
2016/0259282 A1* 9/2016 Komatsu ..... G03G 15/206
2019/0094771 A1* 3/2019 Hazeyama ..... G03G 15/2053

FOREIGN PATENT DOCUMENTS

JP 2007-292948 A 11/2007
JP 2009063755 A * 3/2009
JP 2009210686 A * 9/2009
JP 2016090683 A * 5/2016
JP 2016161672 A * 9/2016
JP 2017021068 A * 1/2017

* cited by examiner

*Primary Examiner* — Robert B Beatty
(74) *Attorney, Agent, or Firm* — Banner & Witcoff, Ltd.

(57) ABSTRACT

A fuser includes: a heater; a rotation body which is heated by the heater; an endless belt; an elastic pad which is in contact with an inner circumferential surface of the endless belt to form a nip portion with the endless belt intervening between the elastic pad and the rotation body; and a wall surrounded by the endless belt and disposed upstream of the elastic pad in a moving direction of the endless belt at the nip portion. The wall has a facing surface facing the elastic pad in the moving direction. The facing surface includes: contact portions positioned at both ends in a width direction of the endless belt and in contact with the elastic pad; and a center portion positioned between the contact portions in the width direction, at an upstream side of the contact portions in the moving direction.

17 Claims, 10 Drawing Sheets

CENTER PORTION

END PORTION

FUSER INCLUDING ROTATION BODY AND ENDLESS BELT

CROSS REFERENCE TO RELATED APPLICATION

The present application claims priority from Japanese Patent Application No. 2017-186931 filed on Sep. 27, 2017, the disclosure of which is incorporated herein by reference in its entirety.

BACKGROUND

Field of the Invention

The present invention relates to a fuser configured to fix or fuse a developer to a recording medium.

Description of the Related Art

There is conventionally known a fuser including a heating roller and a pressure pad that nips an endless belt between itself and the heating roller (see, Japanese Patent Application Laid-open No. 2007-292948). In that fuser, the pressure pad is made by using an elastic body, such as rubber. In the upstream end edge in a sheet conveyance direction of the pressure pad, both ends in a direction orthogonal to the sheet conveyance direction are positioned upstream, in the sheet conveyance direction, of the center portion. The both ends of the pressure pad have a pressure peak, which is upstream of the center portion of the pressure pad in the sheet conveyance direction. In that configuration, when the sheet has reached the fuser, a nip pressure, as the pressure peak, can be applied to both ends in a width direction of the sheet earlier than to the center portion of the sheet. This pulls each end in the width direction of the sheet outward in the width direction, smoothing wrinkles in the sheet. In that configuration, however, the upstream end surface in the sheet conveyance direction of the pressure pad is exposed and deformation of the upstream end surface in the sheet conveyance direction is not regulated uniformly.

SUMMARY

A fuser according to an aspect of the present teaching may include a heater, a rotation body configured to be heated by the heater, an endless belt, an elastic pad, and a wall. The elastic pad may be configured to be in contact with an inner circumferential surface of the endless belt and to form a nip portion with the endless belt intervening between the elastic pad and the rotation body. The wall may be surrounded by the endless belt and disposed upstream of the elastic pad in a moving direction of the endless belt at the nip portion. The wall may have a facing surface which faces the elastic pad in the moving direction. The facing surface may include a first contact portion, a second contact portion, and a center portion. The first contact portion may be positioned at one end in a width direction and in contact with the elastic pad, the width direction being parallel to the endless belt in the nip portion and orthogonal to the moving direction. The second contact portion may be positioned at another end in the width direction and in contact with the elastic pad. The center portion may be positioned between the first contact portion and the second contact portion in the width direction, and upstream of the first contact portion and the second contact portion in the moving direction. The center portion may be out of contact with the elastic pad in a state where the nip portion is not formed.

DESCRIPTION OF THE EMBODIMENTS

Figure 1:
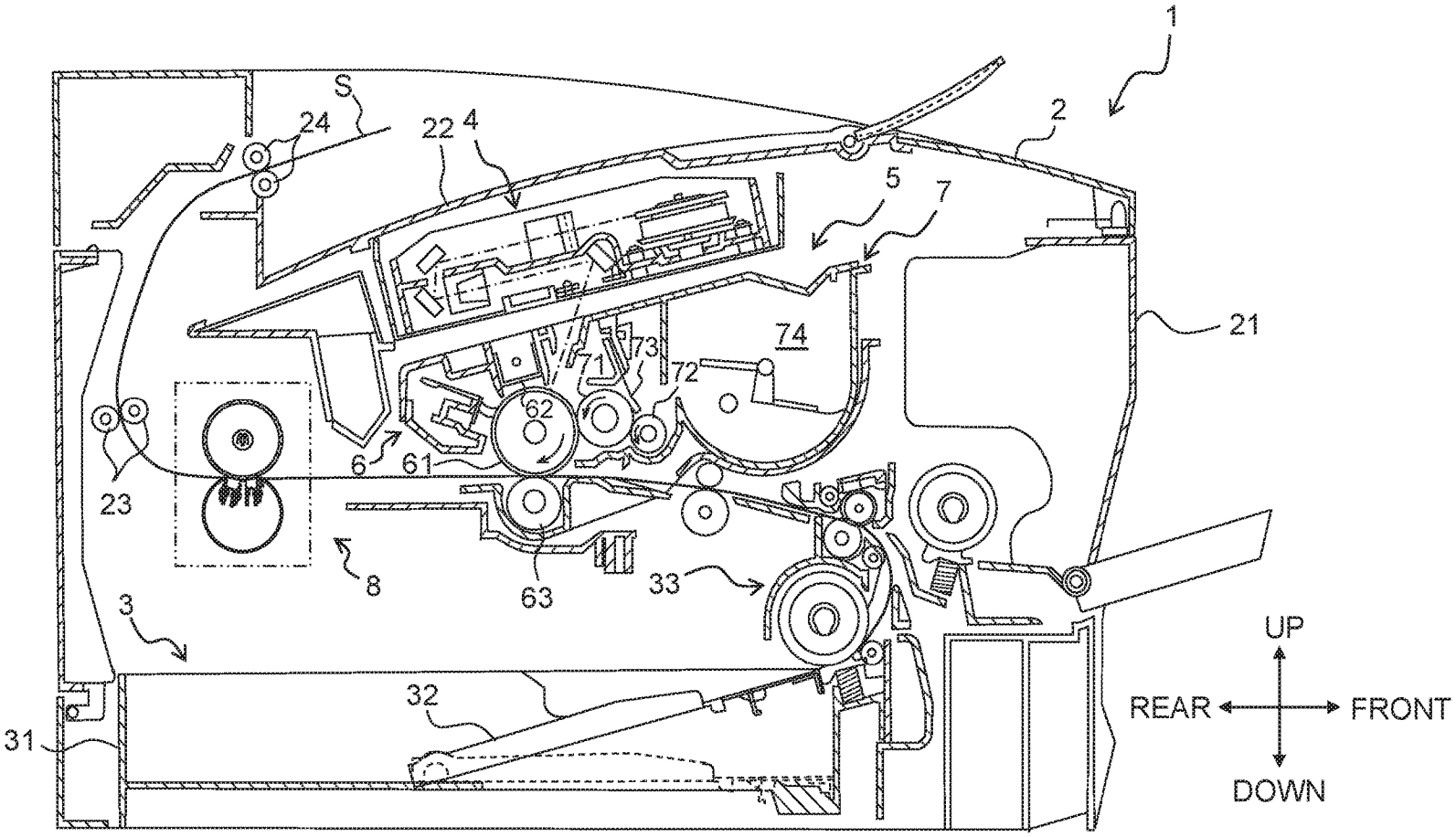
FIG. 1 is a cross-sectional view of an image forming apparatus including a fuser according to an embodiment of the present teaching.

An embodiment of the present teaching is described below in detail with reference to the drawings as appropriate. In the following, directions are defined as follows. That is, the right side in FIG. 1 is defined as the front, the left side in FIG. 1 is defined as the rear, the near side in FIG. 1 is defined as the left, and the far side in FIG. 1 is defined as the right. The up-down direction in FIG. 1 is defined as up and down.

As depicted in FIG. 1, a laser printer 1 includes a casing 2 that is mainly provided with a feed unit 3, an exposure apparatus 4, a process cartridge 5, and a fuser 8.

The feed unit 3, which is disposed in a lower part of the casing 2, mainly includes a feed tray 31 accommodating a sheet S, a sheet pressing plate 32, and a feed mechanism 33. The sheet pressing plate 32 moves the sheet S accommodated in the feed tray 31 upward and then the feed mechanism 33 supplies the sheet S toward the process cartridge 5.

The exposure apparatus 4, which is disposed in an upper part of the casing 2, includes a light source, a polygon mirror, a lens, a reflecting mirror, and the like (reference numerals thereof are omitted in the drawings). In the exposure apparatus 4, a light beam based on image data that is emitted from the light source is scanned on a surface of a photosensitive drum 61 at high speed. Accordingly, the surface of the photosensitive drum 61 is exposed.

The process cartridge 5 is disposed below the exposure apparatus 4. The process cartridge 5 is removably attached to the casing 2 through an opening of the casing 2 that appears when the front cover 21 is opened. The process cartridge 5 includes a drum unit 6 and a developing unit 7. The drum unit 6 mainly includes the photosensitive drum 61, a charger 62, and a transfer roller 63. The developing unit 7, which is removably attached to the drum unit 6, mainly includes a developing roller 71, a supply roller 72, a layer-thickness regulating blade 73, and a toner storage 74 storing a toner.

In the process cartridge 5, the surface of the photosensitive drum 61 is uniformly charged by the charger 62, then is exposed with the light beam from the exposure apparatus 4 to form an electrostatic latent image based on the image data on the photosensitive drum 61. The toner in the toner storage 74 is supplied to the developing roller 71 via the supply roller 72, enters between the developing roller 71 and the layer-thickness regulating blade 73, and is carried, as a thin layer having a certain thickness, on the developing roller 71. The toner carried on the developing roller 71 is supplied from the developing roller 71 to the electrostatic latent image formed on the photosensitive drum 61. This visualizes the electrostatic latent image (the electrostatic latent image is made as a visual image), and a toner image is formed on the photosensitive drum 61. Allowing the sheet S to pass between the photosensitive drum 61 and the transfer roller 63 transfers the toner image formed on the photosensitive drum 61 onto the sheet S.

The fuser 8 is disposed on the rear side of the process cartridge 5. When the sheet S passes the fuser 8, the toner image transferred on the sheet S is fused or fixed thereon. The sheet S to which the toner image is fused is discharged on a discharge tray 22 by using conveyance rollers 23 and 24.

Figure 2:
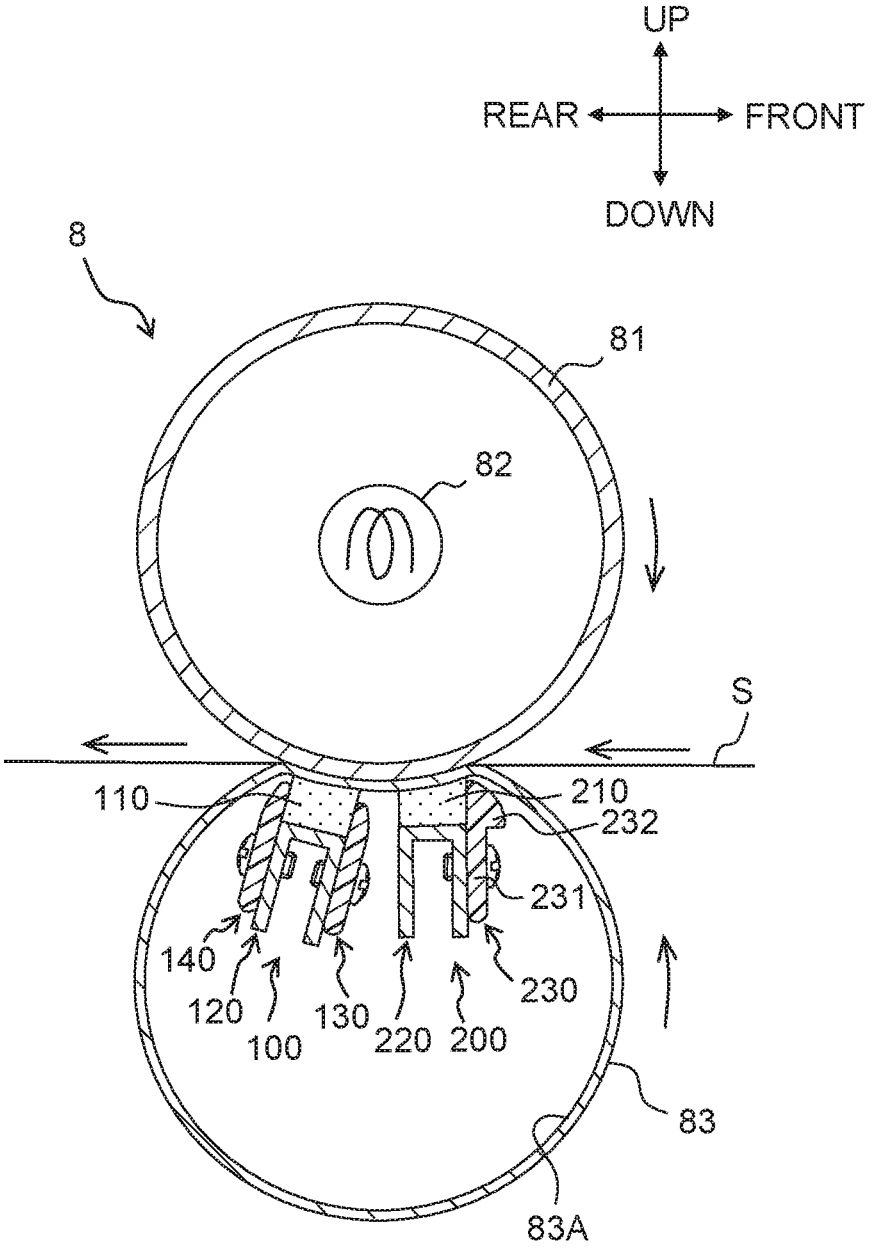
FIG. 2 is a cross-sectional view of the fuser.

As depicted in FIG. 2, the fuser 8 includes a heating roller 81 that is an exemplary rotation body, a heater 82, an endless belt 83, a pressure unit 100, and a pressure unit 200. In the following, a width direction of the endless belt 83 is also simply referred to as a width direction, a moving direction of a part, of the endless belt 83, nipped between the heating roller 81 and the pressure unit 100 or pressure unit 200 is also simply referred to as a moving direction, and a direction perpendicular to the moving direction and the width direction is also referred to as a first direction. In this embodiment, the width direction is along the left-right direction, the moving direction is along the front-rear direction, and the first direction is along the up-down direction.

The heating roller 81 is a cylindrical member. The heating roller 81 is made, for example, by forming a release layer, which is made using fluorine resin or the like, on the outer circumferential surface of a plain pipe, which is made using metal, such as aluminum. The heating roller 81 is rotatably supported by a frame of the fuser 8. The heating roller 81 is driven to rotate clockwise in FIG. 2 when receiving driving force from a motor provided in the casing 2 of the laser printer 1.

The heater 82, which heats the heating roller 81, is disposed inside the heating roller 81. As the heater 82, it is possible to use, for example, a halogen lamp that produces light by electric conduction and heats the heating roller 81 by radiation heat.

The endless belt 83 is a tubular member having flexibility. The endless belt 83 is made, for example, by forming a release layer, which is made using fluorine resin or the like, on the outer circumferential surface of a base member, which is made using, for example, metal such as stainless steel or resin such as polyimide resin. The endless belt 83 is driven to rotate counterclockwise in FIG. 2 due to the rotation of the heating roller 81.

An inner circumferential surface 83A of the endless belt 83 is coated with a lubricant, such as grease. This enhances slidability of the inner circumferential surface 83A of the endless belt 83 to the pressure units 100 and 200, making it possible to rotate the endless belt 83 satisfactorily.

Figure 10A:
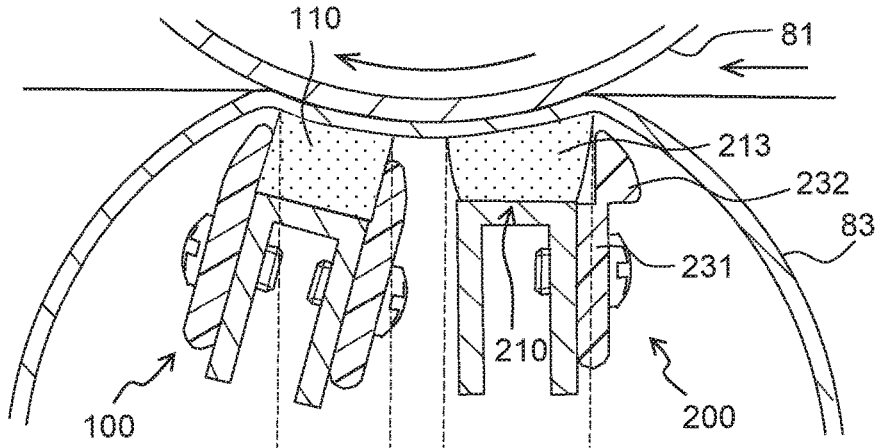
FIG. 10A is a cross-sectional view of a cross-section of a center portion in the width direction of each of the pressure units in the nip state.
Figure 10B:
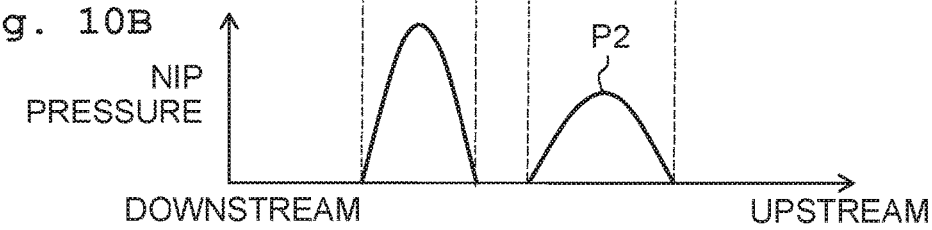
FIG. 10B is a graph indicating a nip pressure distribution in a moving direction in FIG. 10A.
Figure 10C:
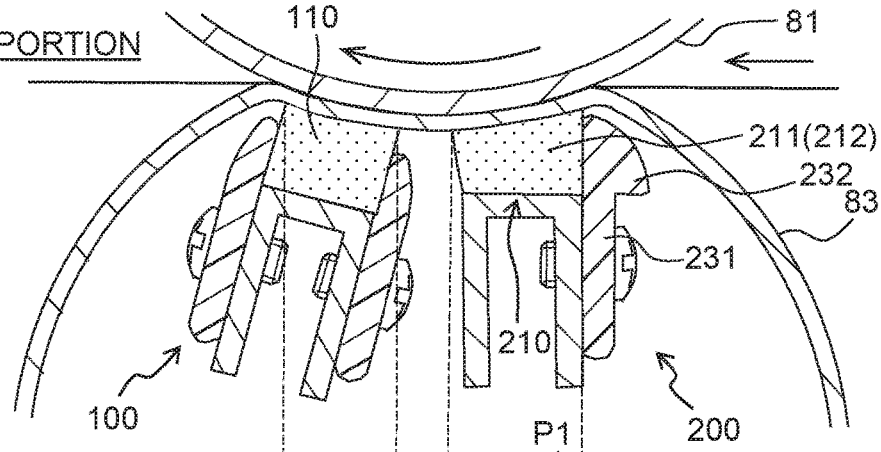
FIG. 10C is a cross-sectional view of a cross-section of an end in the width direction of each of the pressure units in the nip state.
Figure 10D:
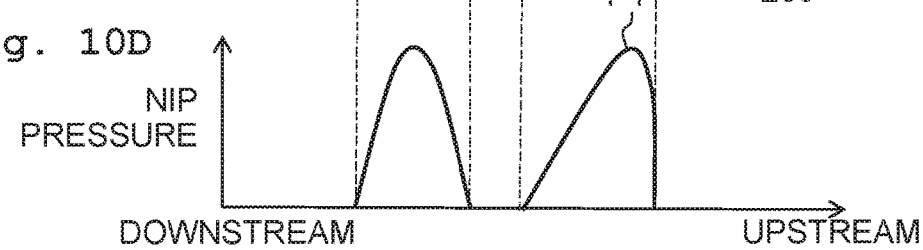
FIG. 10D is a graph indicating a nip pressure distribution in the moving direction in FIG. 10C.
Figure 11A:
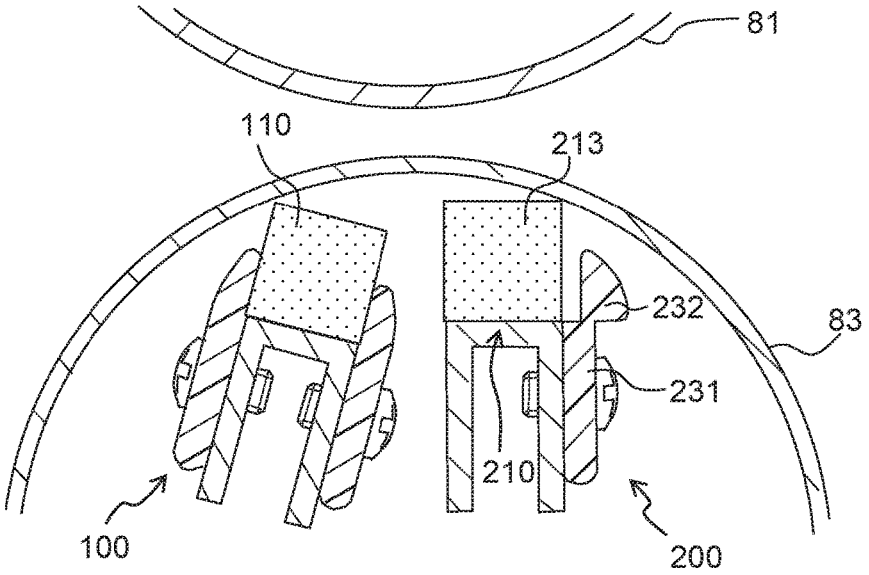
FIG. 11A is a cross-sectional view of a cross-section of the center portion in the width direction of each of the pressure units in the nip release state.
Figure 11B:
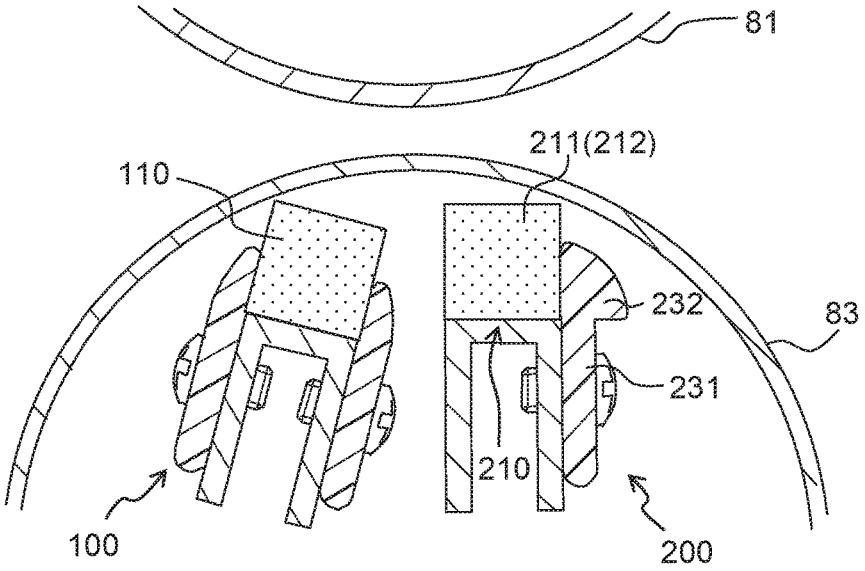
FIG. 11B is a cross-sectional view of a cross-section of the end in the width direction of each of the pressures unit in the nip release state.

The pressure units 100 and 200 are configured to have a nip state (see FIG. 10A) in which the endless belt 83 is nipped between the heating roller 81 and at least one of the pressure units 100 and 200. In the nip state, a nip portion may be formed between the outer circumferential surface of the heating roller 81 and the outer circumferential surface of the endless belt 83 by use of the pressure units 100 and 200. Namely, the nip portion is an area, of the outer circumferential surface of the endless belt 83, which is in contact with the outer circumferential surface of the heating roller 81. The nip portion may include a first nip portion, a second nip portion, and an intermediate portion. The first nip portion is an area corresponding to a first part, of the endless belt 83, which is sandwiched between the pressure unit 200 and the heating roller 81. The second nip portion is an area corresponding to a second part, of the endless belt 83, which is downstream of the first part in the moving direction and which is sandwiched between the pressure unit 100 and the heating roller 81. The intermediate portion is an area corresponding to an intermediate part, of the endless belt 83, which is sandwiched between the first part and the second part of the endless belt 83 in the moving direction. Since the pressure units 100 and 200 are arranged apart from each other in the moving direction, neither the pressure unit 100 nor the pressure unit 200 directly applies pressure to the intermediate portion. The endless belt 83 and the heating roller 81 are in contact with each other also in the intermediate portion. Therefore, when the sheet S passes the intermediate portion, heat is applied to the sheet S by the heating roller 81 but little pressure is applied to the sheet S. Each of the pressure units 100 and 200 is also configured to have a nip release state (see FIGS. 11A and 11B) in which no pressure is applied between each of the pressure units 100 and 200 and the heating roller 81. In the nip release state, the heating roller 81 may be in contact with the outer circumferential surface of the endless belt 83, and the inner circumferential surface 83A of the endless belt 83 may be in contact with the pressure units 100 and 200. In that case, it may be preferable that no pressing force is applied between each the pressure units 100 and 200 and the heating roller 81. Specifically, for example, a first end and a second end in the width direction of each of the pressure units 100 and 200 are held integrally by two holding members 300 depicted in FIG. 5. Each of the two holding members 300 is configured to be urged toward the heating roller 81 by use of a spring 310 and to be pressed by a cam in a direction away from the heating roller 81 against the urging force of the spring 310. This allows each of the pressure units 100 and 200 to be switched between the nip state and the nip release state. Alternatively, each of the pressure units 100 and 200 may have the nip state by urging the heating roller 81 toward each of the pressure units 100 and 200 by use of the spring, and may have the nip release state by pressing the heating roller 81 by use of the cam in the direction away from each of the pressure units 100 and 200 against the urging force of the spring.

The pressure unit 100 includes the pressure pad 110, a stay 120, an upstream holder 130, and a downstream holder 140. The pressure pad 110 is in contact with the inner circumferential surface 83A of the endless belt 83 to nip the endless belt 83 between itself and the heating roller 81.

The pressure unit 200 includes the pressure pad 210 that is an exemplary pressure pad, a stay 220, and a holder 230. The pressure pad 210 is in contact with the inner circumferential surface 83A of the endless belt 83 to nip the endless belt 83 between itself and the heating roller 81. The pressure pad 210 is disposed upstream of the pressure pad 110 of the pressure unit 100 in the moving direction.

Figure 3:
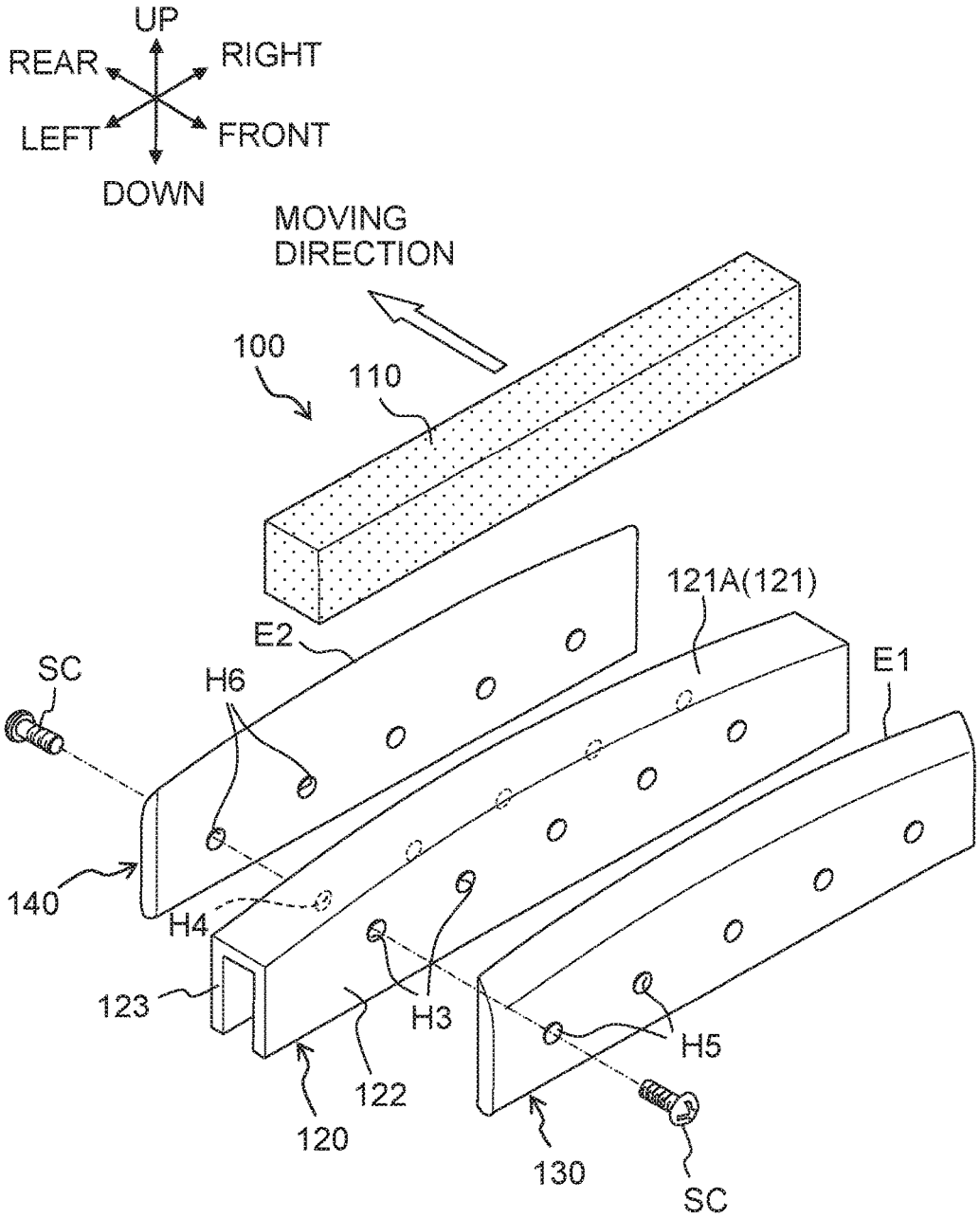
FIG. 3 is an exploded perspective view of a pressure unit.

As depicted in FIG. 3, the pressure pad 110 of the pressure unit 100 has a rectangular parallelepiped shape that is long in the left-right direction. The pressure pad 110, which is made by using an elastic material such as rubber, is elastically deformable.

The stay 120 is a frame for supporting the pressure pad 110. The stay 120 is made by using resin or metal that is more rigid than the pressure pad 110. The stay 120 is larger than the pressure pad 110 in the width direction (see FIG. 4). The stay 120 includes a base 121 to which the pressure pad 110 is secured, an upstream wall 122 extending from the upstream end in the moving direction of the base 121 in a direction away from the pressure pad 110, and a downstream wall 123 extending from the downstream end in the moving direction of the base 121 in the direction away from the pressure pad 110.

Figure 5:
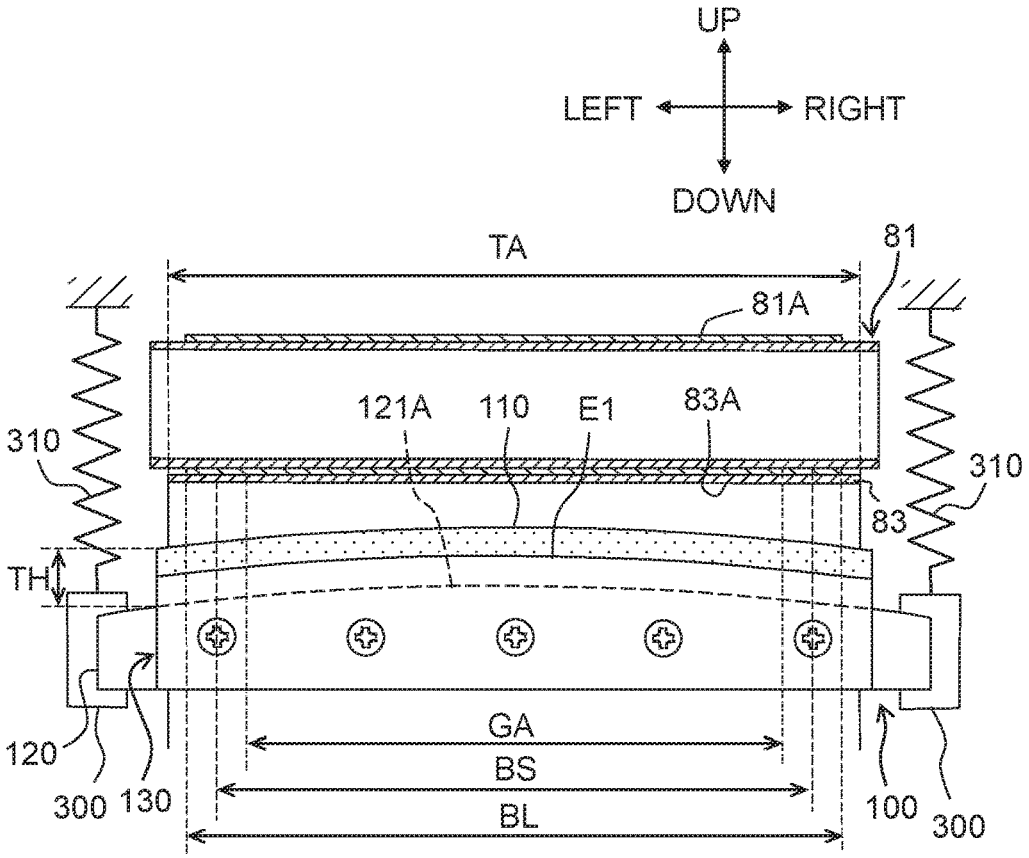
FIG. 5 depicts a heating roller and the pressure unit which are in a nip release state.

The upper surface of the base 121 is a support surface 121A that supports the pressure pad 110 from a side opposite to the heating roller 81. The base 121 curves so that the center side in the width direction of the base 121 is more convex toward the heating roller 81. In that configuration, as depicted in FIG. 5, in the nip release state in which no pressure is applied between the heating roller 81 and the pressure pad 110, the support surface 121A is inclined so that both ends in the width direction of the support surface 121A are positioned farther from the heating roller 81 than the center in the width direction of the support surface 121A.

In other words, the support surface 121A is a curved surface that is convex toward the heating roller 81. In this embodiment, the pressure pad 110 is larger in the width direction than the endless belt 83, and the support surface 121A is larger in the width direction than the pressure pad 110. Both ends in the width direction of the pressure pad 110 extend beyond both ends in the width direction of the endless belt 83, and the both ends in the width direction of the support surface 121A extend beyond the both ends in the width direction of the pressure pad 110.

Although the entire support surface 121A is the curved surface in this embodiment, the present teaching is not limited thereto. For example, the support surface 121A may be a curved surface at least in an image formation area GA of a sheet having a largest size for which fusing can be performed by the fuser 8. For example, the support surface 121A may be a curved surface only in a width BS of the sheet having the largest size for which fusing can be performed by the fuser 8, or a curved surface only in a width BL of a release layer 81A formed on the outer circumferential surface of the heating roller 81. The support surface 121A may be a curved surface only in an area TA in which the pressure pad 110 is in contact with the inner circumferential surface 83A of the endless belt 83.

Figure 4:
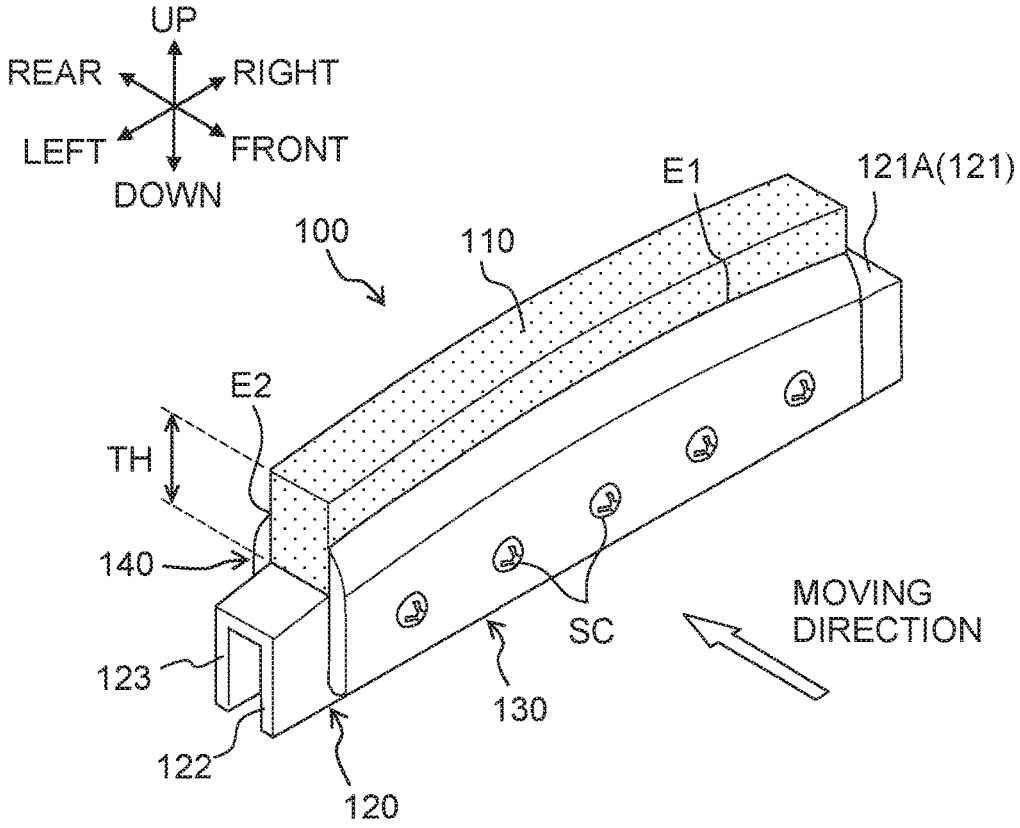
FIG. 4 is a perspective view of the pressure unit assembled.

The pressure pad 110 is secured to the support surface 121A. Specifically, the pressure pad 110 is bonded and secured to the support surface 121A directly. As depicted in FIGS. 4 and 5, a thickness TH of the pressure pad 110 in the nip release state (i.e., the thickness TH in a direction in which the pressure pad 110 faces the heating roller 81) is constant at least in the area TA where the pressure pad 110 is in contact with the inner circumferential surface 83A of the endless belt 83. In other words, in the nip release state, the height of the pressure pad 110 from the support surface 121A is constant at least in the area TA.

As depicted in FIG. 3, the upstream wall 122 of the stay 120 has holes H3. Screws SC are screwed into the holes H3, securing the upstream holder 130 to the upstream wall 122.

The downstream wall 123 of the stay 120 has holes H4. Screws SC are screwed into the holes 114, securing the downstream holder 140 to the downstream wall 123.

The upstream holder 130, which is a plate-shaped member made by using resin or metal, is disposed upstream of the pressure pad 110 in the moving direction. The upstream holder 130 has holes 1-15 into which screws SC can be inserted.

The downstream holder 140 has substantially the same structure as the upstream holder 130, specifically, the downstream holder 140 and the upstream holder 130 are configured symmetrically in the front-rear direction. The downstream holder 140, which is a plate-shaped member made by using resin or metal, is disposed downstream of the pressure pad 110 in the moving direction. The downstream holder 140 has holes H6 into which screws SC can be inserted.

As depicted in FIGS. 4 and 5, the upstream holder 130 and the downstream holder 140 extend beyond the support surface 121A toward the heating roller 81 in a state where the holders 130 and 140 are attached to the stay 120. The upstream holder 130 and the downstream holder 140, specifically, parts of the upstream holder 130 and the downstream holder 140 extending beyond the support surface 121A toward the heating roller 81 are in contact with the pressure pad 110 in the nip release state.

An end edge E1 of the upstream holder 130 on the heating roller 81 side is inclined along the support surface 121A. Specifically, the end edge E1 has a convex curved line that is along the support surface 121A that is a convex curved surface.

An end edge E2 of the downstream holder 140 on the heating roller 81 side is inclined along the support surface 121A (see FIG. 3). Specifically, the end edge E2 has the convex curved line that is along the support surface 121A that is the convex curved surface.

Figure 6:
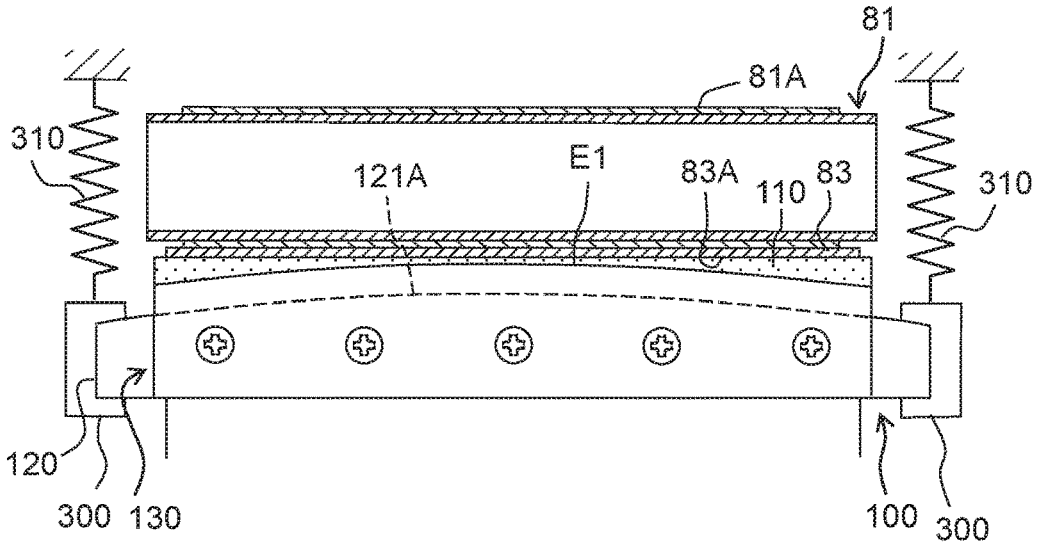
FIG. 6 depicts the heating roller and the pressure unit which are in a nip state.

As depicted in FIG. 6, in the nip state, both ends in the width direction of the stay 120 of the pressure unit 100 are urged toward the heating roller 81. In that configuration, if the support surface 121A is a flat surface, the nip pressure between the heating roller 81 and the pressure pad 110 is as follows. Namely, the nip pressure at the both ends in the width direction is high, and the nip pressure at the center portion in the width direction is low, as indicated by the broken line in FIG. 7. In this embodiment, the support surface 121A is the convex curved surface. Thus, as depicted by the solid line in FIG. 7, the nip pressure at the center portion in the width direction increases, making it possible to reduce the difference between the nip pressure at the both ends in the width direction and the nip pressure at the center portion in the width direction.

Figure 8A:
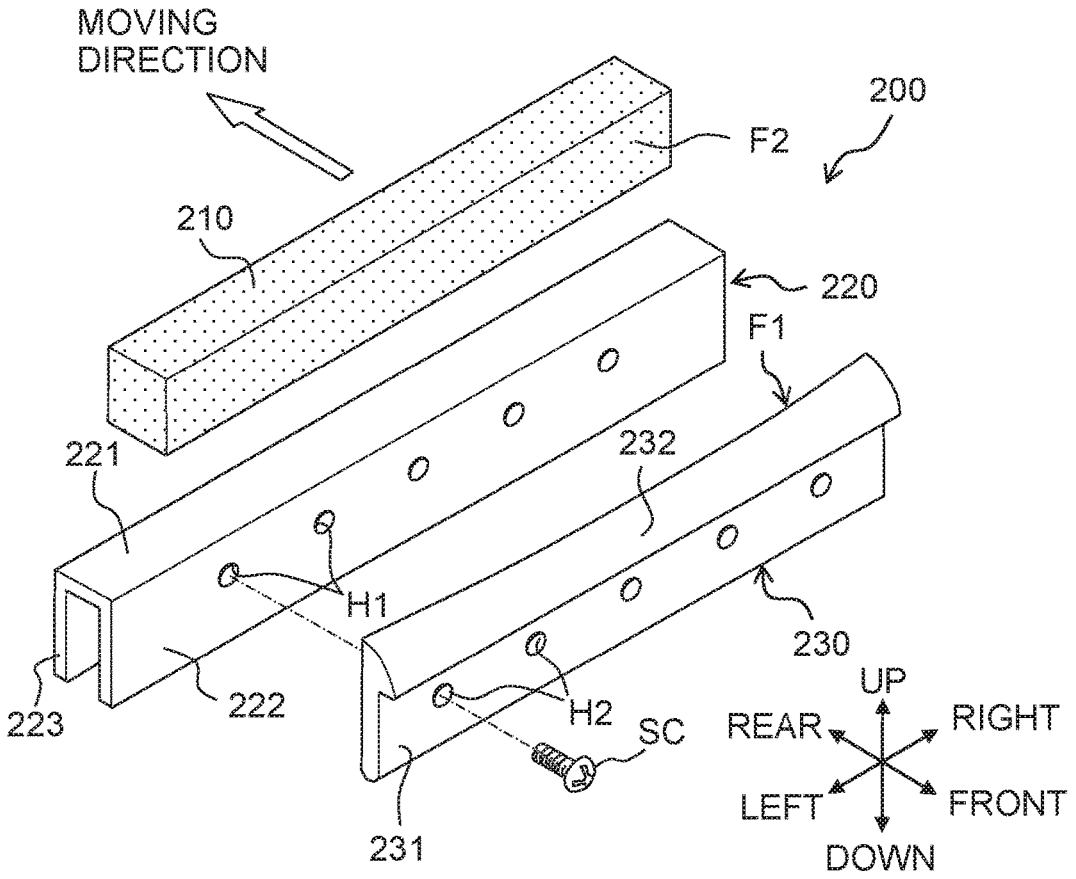
FIG. 8A is an exploded perspective view of another pressure unit.
Figure 8B:
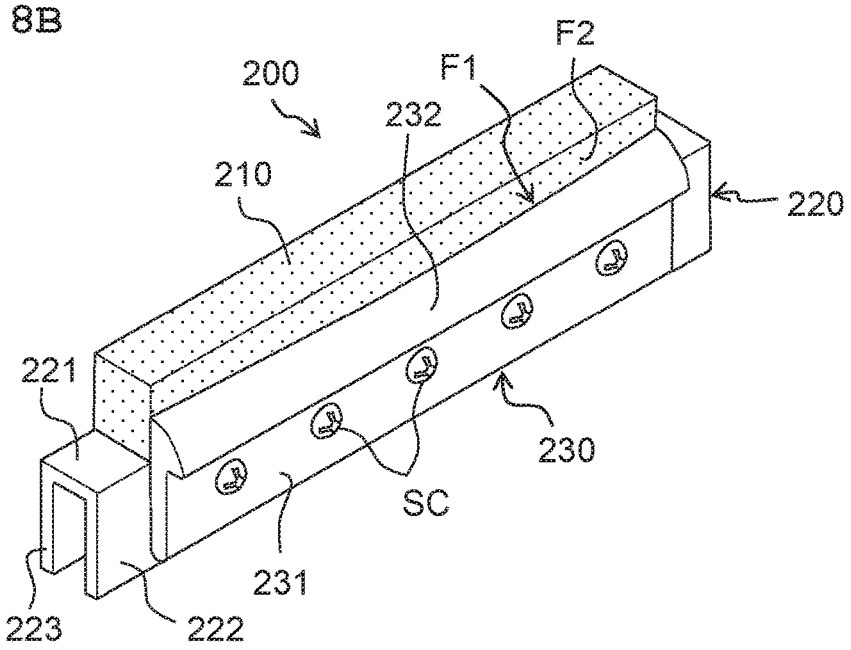
FIG. 8B is a perspective view of the another pressure unit assembled.

As depicted in FIGS. 8A and 8B, the pressure pad 210 of the pressure unit 200 has a rectangular parallelepiped shape that is long in the left-right direction. The pressure pad 210, which is made by using an elastic material such as rubber, is elastically deformable.

The stay 220 is a frame for supporting the pressure pad 210. The stay 220 is made by using resin or metal. The stay 220 includes a base 221 to Which the pressure pad 210 is secured, an upstream wall 222 extending from the upstream end in the moving direction of the base 221 in a direction away from the pressure pad 210, and a downstream wall 223 extending from the downstream end in the moving direction of the base 221 in the direction away from the pressure pad 210. The upstream wall 222 has holes H1. Screws SC are screwed into the holes H1, securing the holder 230 to the upstream wall 222.

The holder 230 is made by using resin or metal. The holder 230 includes a base 231 that overlaps with the stay 220 in the moving direction, and a wall 232 that does not overlap with the stay 220 in the moving direction (see FIG. 2). The base 231 has holes H2 into which screws SC are inserted, securing the holder 230 to the upstream wall 222 of the stay 220.

The wall 232 extends beyond the base 221 of the stay 220 toward the heating roller 81 and extends beyond the base 231 of the holder 230 toward the upstream side in the moving direction. The wall 232 is disposed upstream of the pressure pad 210 in the moving direction. The wall 232 has such a height that the endless belt 83 is not nipped between the wall 232 and the heating roller 81 (see FIG. 2). In this embodiment, the wall 232 is disposed separately from the endless belt 83.

Figure 9A:
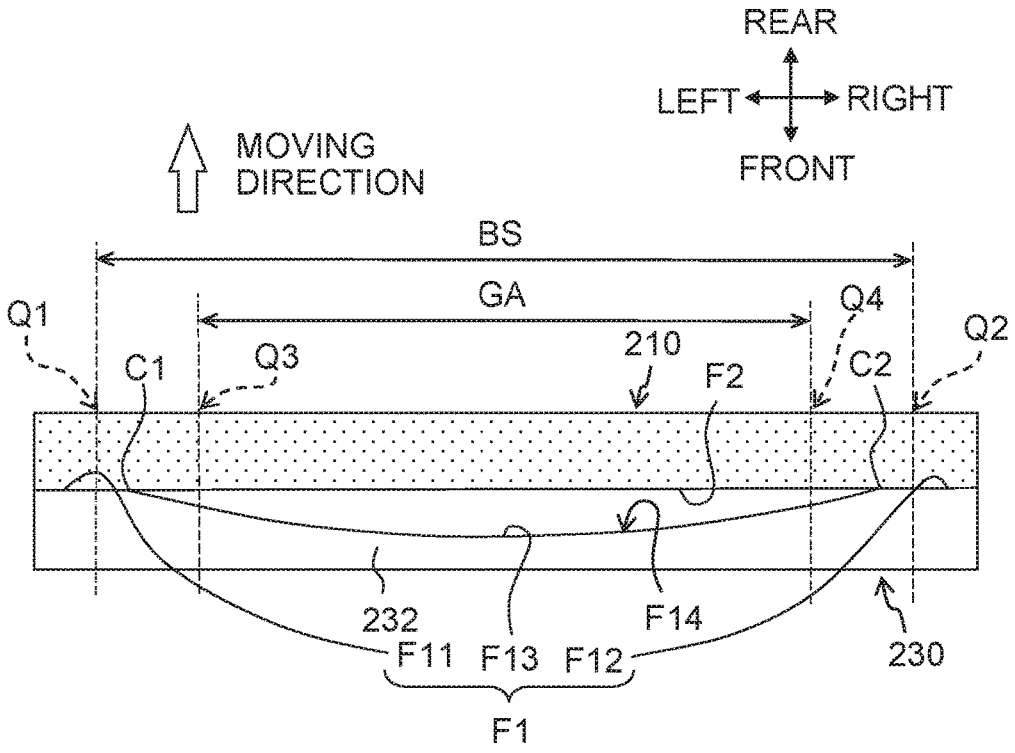
FIG. 9A is a top view of the another pressure unit in the nip release state.

As depicted in FIG. 9A, the wall 232 has a facing surface F1 that faces the pressure pad 210 in the moving direction. FIG. 9A depicts the nip release state in which the endless belt 83 is not nipped between the heating roller 81 and the pressure pad 210. In the nip release state, an upstream side surface F2, of side surfaces of the pressure pad 210, facing the wall 232, specifically, the upstream side surface F2 facing the wall 232 in the moving direction, is a flat surface orthogonal to the moving direction.

The facing surface F1 has a contact portion F11 positioned on a first end side in the width direction, a contact portion F12 positioned on a second end side in the width direction, and a center portion F13 positioned at the center in the width direction. The contact portion F11 and the contact portion F12 are flat surfaces extending along the upstream side surface F2 of the pressure pad 210. In the nip release state, the contact portion F11 and the contact portion F12 are in contact with the upstream side surface F2 of the pressure pad 210.

A part of the facing surface F1 between the contact portion F11 and the contact portion F12 is a curved surface F14 that continues from the contact portions F11 and F12 and is concave toward the upstream side in the moving direction. In that configuration, the center portion F13, in the vicinity of the center of the facing surface F1, is positioned upstream of the contact portions F11 and F12 in the moving direction. The center portion F13 in the nip release state is not brought into contact with the pressure pad 210. In other words, the center portion F13 in the nip release state is separated from the upstream side surface F2 of the pressure pad 210.

The wall 232 has a corner C1 at a boundary between the contact portion F11 and the curved surface F14 and a corner C2 at a boundary between the contact portion F12 and the curved surface F14. The corner C1 and the corner C2 are positioned outside, in the width direction, the image formation area GA of the sheet having the largest size for which fusing can be performed by the fuser 8, and inside, in the width direction, the width BS of the sheet having the largest size. In other words, the corner C1 is positioned between a position Q1 and a position Q3, the position Q1 and the position Q3 being positions at which one side in the width direction of the sheet having the largest size and one side in the width direction of the image formation area GA pass respectively when the sheet having the largest size passes between the heating roller 81 and the endless belt 83. The corner C2 is positioned between a position Q2 and a position Q4, the position Q2 and the position Q4 being positions at which another side in the width direction of the sheet having the largest size and another side in the width direction of the image formation area GA pass respectively when the sheet having the largest size passes between the heating roller 81 and the endless belt 83.

Figure 9B:
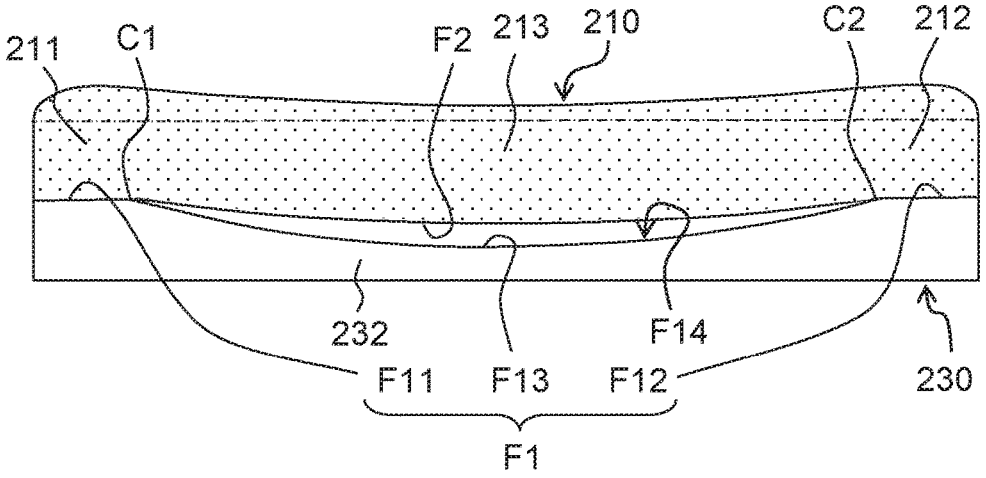
FIG. 9B is a top view of the another pressure unit in the nip state.

Subsequently, explanation is made on the action and effect of the fuser 8 according to this embodiment. When each of the pressure units 100 and 200 depicted in FIG. 2 is changed from the nip release state to the nip state, a center portion 213 of the pressure pad 210 is deformed to be convex toward the upstream side in the moving direction, as depicted in FIG. 9B. In this embodiment, in the nip state, the center portion 213 of the pressure pad 210 is separated from the wall 232 without any contact therewith. The deformation of the ends 211 and 212 of the pressure pad 210 toward the upstream side in the moving direction is regulated by the contact portions F11 and F12 of the wall 232.

In that configuration, as depicted in FIGS. 10A to 10D, a pressure peak P1 of each of the ends 211 and 212 in the width direction of the pressure pad 210 is larger than a pressure peak P2 of the center portion 213, and the pressure peak P1 is closer to the upstream side in the width direction than the pressure peak P2. This makes it easy for the ends of the sheet S to be caught when the leading end of the sheet S enters the nip portion between the pressure pad 210 and the heating roller 81, thus preventing wrinkles in the sheet S.

Figure 7:
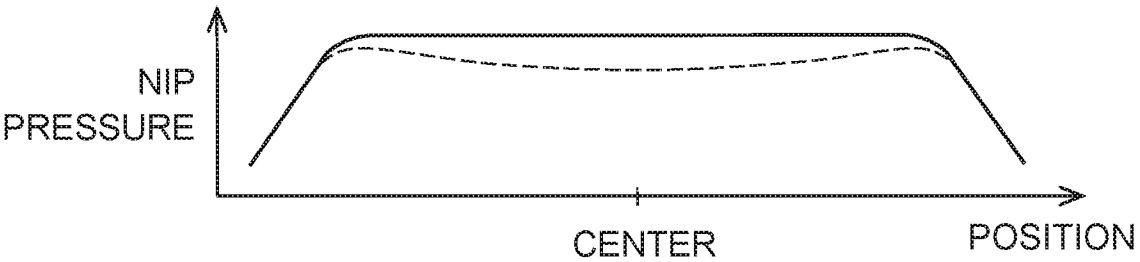
FIG. 7 is a graph indicating a nip pressure distribution in a width direction.

In the nip state, the nip pressure of the pressure pad 110 in the width direction is substantially uniform, as depicted in FIG. 7. This allows the nip portion between the pressure pad 110 and the heating roller 81 to apply the substantially uniform nip pressure to the sheet S, making it possible to thermally fix or fuse a toner image to the sheet S satisfactorily.

This embodiment can obtain the following effects. The deformation of the pressure pad 210 is controlled by the shape of the facing surface F1 of the wall 232. Regardless of production error in the pressure pad 210, the pressure peak P1 of each of the ends 211 and 212 in the width direction of the pressure pad 210 is positioned upstream of the pressure peak P2 of the center portion 213, preventing wrinkles in the sheet S.

In this embodiment, the part of the facing surface F1 between the contact portion F11 and the contact portion F12 is the curved surface F14 continuing from the contact portions F11 and F12. This configuration can change a nip width and nip pressure continuously, preventing wrinkles in the sheet S more effectively than, for example, a case in which a concave in the facing surface has a stepped shape.

Parts of the pressure pad 210 of which deformation is regulated by the corner C1 and the corner C2 may badly affect an image formed in the image formation area GA. In this embodiment, however, the corners C1 and C2 are positioned outside the image formation area GA, preventing a situation in which the parts of the pressure pad 210 of which deformation is regulated by the corner C1 and the corner C2 are pressed against the image formation are GA. This thus prevents deterioration in image quality.

In the above configuration, the corners C1 and C2 are positioned inside the width BS of the sheet having the largest size. This allows the parts of the pressure pad 210 of which deformation is regulated by the contact portions F11 and F12 to reliably apply the nip pressure to both ends in the width direction of the sheet having the largest size, satisfactory preventing wrinkles in the sheet having the largest size.

In this embodiment, the pressure pad 210 has the rectangular parallelepiped shape, making it possible to reduce the production error in the pressure pad 210 and the installation error caused when the pressure pad 210 is installed in the stay 220 more effectively than, for example, a case in which the pressure pad 210 has a complicated shape.

In this embodiment, the pressure pad 110 having a constant thickness is secured to the convex support surface 121A of the stay 120 that is more rigid than the pressure pad 110. This reduces the production error and the installation error in the pressure pad 110 and reduces the difference in the nip pressure distribution in the width direction more effectively than, for example, a configuration in which the nip pressure distribution in the width direction is adjusted by changing the thickness of the pressure pad 110.

In this embodiment, the end edge E1 and the end edge E2 of the holders 130 and 140 extend along the convex support surface 121A. This allows the holders 130 and 140 to regulate deformation of the center portion in the width direction of the pressure pad 110 more effectively than, for example, a case in which the end edges of the holders linearly extend in the width direction, thus reliably preventing image deterioration which may otherwise be caused by pressure relief for the center portion in the width direction of the pressure pad 110.

In this embodiment, the support surface 121A is the curved surface in the image formation area GA of the sheet having the largest size for which fusing can be performed by the fuser 8. This prevents image deterioration more effectively than, for example, a case in which the support surface in the image formation area has the stepped shape.

In this embodiment, the pressure pad 110 is bonded and secured to the support surface 121A directly. In that configuration, the pressure pad 110 follows the convex support surface 121A more effectively than, for example, a configuration in which another member is disposed between the pressure pad 110 and the support surface, thus reducing the difference in the nip pressure in the width direction.

In this embodiment, the pressure pad 110 is the rectangular parallelepiped shape. This reduces the production error in the pressure pad 110 and the installation error caused when the pressure pad 110 is installed in the stay 120 more effectively than, for example, a case in which the pressure pad 110 has a complicated shape.

The present teaching is not limited to the above embodiment, and can be used in a variety of embodiments as described below.

In the above embodiment, the fuser 8 includes the two pressure units 100 and 200. The present teaching, however, is not limited thereto. The fuser 8 may include at least the pressure unit 200.

In the above embodiment, the pressure pad 210 has the rectangular parallelepiped shape. The present teaching, however, is not limited thereto. The pressure pad 210 may have any other shape. The pressure pad 210 may have, for example, a shape similar to that of a conventional pressure pad. Specifically, the pressure pad 210 may be configured as follows. Namely, in the upstream end edge of the pressure pad 210, both ends in the width direction are positioned upstream, in the moving direction, of the center portion in the width direction.

In the above embodiment, in the nip state, the center portion 213 in the width direction of the pressure pad 210 is not brought into contact with the wall 232. The present teaching, however, is not limited thereto. For example, in the nip state, the center portion 213 in the width direction of the pressure pad 210, specifically, the center portion in the width direction of the upstream side surface F2 may be brought into contact with the wall 232.

In the above embodiment, the halogen lamp is an example of the heater 82. The present teaching, however, is not limited thereto. The heater may be, for example, a carbon heater.

In the above embodiment, the heating roller 81 with the built-in heater is an example of the rotation body. The present teaching, however, is not limited thereto. The rotation body may be, for example, an endless heating belt of which inner circumferential surface is heated with a heater. The heating system may be an external heating system in which a heater is disposed outside the rotation body to heat the outer circumferential surface of the rotation body or an Induction Heating (IH) system. A heater may be provided in the endless belt to heat the rotation body indirectly. Each of the rotation body and the endless belt may include a heater.

In the above embodiment, the wall 232 is formed in the holder 230, which is secured to the stay 220. The present teaching, however, is not limited thereto. For example, when a support member including a base that supports the pressure pad from below is provided, a wall protruding from the base of the support member toward the heating roller may be formed.

In the above embodiment, the contact portion F11 and the contact portion F12 are the flat surfaces. The present teaching, however, is not limited thereto. The contact portion F11 and the contact portion F12 may be, for example, curved surfaces.

In the above embodiment, the part of the facing surface F1 between the contact portion F11 and the contact portion F12 is the curved surface F14 continuing from the portions H1 and F12. The present teaching, however, is not limited thereto. The part of the facing surface F1 between the contact portion F11 and the contact portion F12 may have any other shape provided that the part is concave toward the upstream side in the moving direction. Specifically, the part of the facing surface F1 between the contact portion F11 and the contact portion F12 may be a stepped recess or a V-shaped recess.

In the above embodiment, the pressure pad 110 has the rectangular parallelepiped shape. The present teaching, however, is not limited thereto. The pressure pad 110 may have any other shape. Specifically, the pressure pad 110 may have a configuration as follows. Namely, in the upstream end edge of the pressure pad 110, the both ends in the width direction may be positioned upstream, in the moving direction, of the center portion in the width direction. In that configuration also, the same effect as the above embodiment can be obtained provided that the thickness of the pressure pad 110 is constant.

In the above embodiment, the support surface 121A is the curved surface. The present teaching, however, is not limited thereto. The support surface 121A may be, for example, a stepped protrusion or a V-shaped protrusion.

In the above embodiment, the two holders 130 and 140 are arranged with the pressure pad 110 intervening therebetween in the moving direction. The present teaching, however, is not limited thereto. For example, the holder 130 or the holder 140 may be provided at the upstream side or the downstream side in the moving direction of the pressure pad 110, or no holders may be provided at both sides in the moving direction of the pressure pad 110 to expose upstream and downstream side surfaces in the moving direction of the pressure pad 110.

The respective elements explained in the embodiment and modified examples may be used in a combined manner.

What is claimed is:

1. A fuser, comprising:

a heater;

a rotation body configured to be heated by the heater;

an endless belt;

an elastic pad configured to be in contact with an inner circumferential surface of the endless belt and to form a nip portion with the endless belt intervening between the elastic pad and the rotation body; and a wall surrounded by the endless belt and disposed upstream of the elastic pad in a moving direction of the endless belt at the nip portion;

wherein the wall has a facing surface which faces the elastic pad in the moving direction, the facing surface includes:

a first contact portion which is positioned at one end in a width direction and which is in contact with the elastic pad, the width direction being parallel to the endless belt in the nip portion and orthogonal to the moving direction;

a second contact portion which is positioned at another end in the width direction and which is in contact with the elastic pad; and a center portion which is positioned between the first contact portion and the second contact portion in the width direction, and upstream of the first contact portion and the second contact portion in the moving direction, and the center portion is out of contact with the elastic pad in a state where the nip portion is not formed.

2. The fuser according to claim 1, wherein the facing surface has a curved surface which is between the first contact portion and the second contact portion in the width direction and which continues from the first contact portion and the second contact portion.

3. The fuser according to claim 2, wherein the elastic pad includes an upstream side surface which faces the wall in the moving direction and which is flat, wherein the first contact portion and the second contact portion are flat surfaces along the upstream side surface, wherein the wall has: a first corner at a boundary between the first contact portion and the curved surface; and a second corner at a boundary between the second contact portion and the curved surface, wherein, in a case that a largest sheet acceptable for the fuser passes the nip portion, one side in the width direction of the largest sheet passes a first position of the nip portion, another side in the width direction of the largest sheet passes a second position of the nip portion, one side in the width direction of a largest image formation area of the largest sheet passes a third position of the nip portion, and another side in the width direction of the largest image formation area passes a fourth position of the nip portion, wherein the first corner of the wall is positioned between the first position and the third position of the nip portion in the width direction, and wherein the second corner of the wall is positioned between the second position and the fourth position of the nip portion in the width direction.

4. The fuser according to claim 1, wherein the elastic pad in a natural state as a rectangular parallelepiped shape.

5. The fuser according to claim 1, further comprising a stay configured to support the elastic pad and disposed on an opposite side of the rotation body with the elastic pad intervening between the stay and the rotation body, wherein the wall is secured to the stay with a screw.

6. The fuser according to claim 1, wherein the wall is out of contact with the endless belt in a state where the nip portion is formed.

7. The fuser according to claim 1, further comprising:

a second elastic pad configured to be in contact with the inner circumferential surface of the endless belt and to form a second nip portion with the endless belt intervening between the second elastic pad and the rotation body; and a stay having a support surface configured to support the second elastic pad and disposed on an opposite side of the rotation body with the second elastic pad intervening between the stay and the rotation body, wherein the support surface is inclined such that both ends in the width direction of the support surface are away farther from the rotation body than a center in the width direction of the support surface, and wherein a thickness, in a direction orthogonal to the support surface, of the second elastic pad is constant at least in an area corresponding to the second nip portion.

8. The fuser according to claim 7, further comprising:

an upstream holder disposed upstream of the second elastic pad in the moving direction and brought into contact with the second elastic pad; and a downstream holder disposed downstream of the second elastic pad in the moving direction and brought into contact with the second elastic pad, wherein a first end edge, of the upstream holder, closest to the second nip portion and a second end edge, of the downstream holder, closest to the second nip portion are inclined along the support surface.

9. The fuser according to claim 8, wherein the first end edge and the second end edge are out of contact with the endless belt in a state where the second nip portion is formed.

10. The fuser according to claim 8, wherein the upstream holder and the downstream holder are secured to the stay with screws.

11. The fuser according to claim 8, wherein the support surface is a curved surface at least in an image formation area of a largest sheet acceptable for the fuser.

12. The fuser according to claim 8, the second elastic pad is directly bonded and secured to the support surface.

13. The fuser according to claim 7, wherein the second elastic pad in a natural state has a rectangular parallelepiped shape.

14. The fuser according to claim 7, wherein the elastic pad is disposed separately from the second elastic pad in the moving direction.

15. The fuser according to claim 14, wherein the second elastic pad is disposed downstream of the elastic pad in the moving direction.

16. The fuser according to claim 7, further comprising a second stay having a second support surface configured to support the elastic pad and disposed on an opposite side of the rotation body with the elastic pad intervening between the second stay and the rotation body, wherein the support surface is inclined to the second support surface when seen from the width direction.

17. The fuser according to claim 1, wherein the rotation body includes a plain pipe made by using metal, and the heater is disposed in the plain pipe.

* * * * *